US008955362B2

(12) United States Patent
Booth

(10) Patent No.: US 8,955,362 B2
(45) Date of Patent: Feb. 17, 2015

(54) APPARATUS FOR AND METHOD OF MANUFACTURING HELICALLY WOUND STRUCTURES

(75) Inventor: John Peter Booth, Yorkshire (GB)

(73) Assignee: ITI Scotland Limited, Glasgow (GB)

( * ) Notice: Subject to any disclaimer, the term of this patent is extended or adjusted under 35 U.S.C. 154(b) by 0 days.

(21) Appl. No.: 13/562,801

(22) Filed: Jul. 31, 2012

(65) Prior Publication Data

US 2012/0291956 A1 Nov. 22, 2012

Related U.S. Application Data

(62) Division of application No. 12/086,982, filed as application No. PCT/GB2006/050471 on Dec. 21, 2006.

(30) Foreign Application Priority Data

Dec. 23, 2005 (GB) ..... 0526409.8

(51) Int. Cl.
*B21C 37/12* (2006.01)

(52) U.S. Cl.
CPC ..... *B21C 37/12* (2013.01); *B21C 37/123* (2013.01); *B21C 37/126* (2013.01); *B21C 37/128* (2013.01)
USPC ..... 72/50; 72/49

(58) Field of Classification Search
USPC ..... 72/400, 48–52, 370.25, 370.24, 370.21, 72/370.1, 367.1, 215, 136, 112, 86, 80, 72/137, 214, 135, 126, 370.23, 369, 368, 72/78
See application file for complete search history.

(56) References Cited

U.S. PATENT DOCUMENTS

| | | | | |
|---|---|---|---|---|
| 2,094,919 | A | | 10/1937 | Hughes |
| 2,265,246 | A | * | 12/1941 | Ott ..... 72/371 |
| 2,290,380 | A | | 7/1942 | Pierce |
| 2,343,747 | A | | 3/1944 | Chernack |
| 2,567,020 | A | | 9/1951 | Keuter |
| 3,229,487 | A | | 1/1966 | Jensen |
| 3,256,724 | A | | 6/1966 | Wiley |
| 3,263,321 | A | | 8/1966 | Lombardi |
| 3,707,170 | A | | 12/1972 | Mazuir et al. |
| 3,768,260 | A | | 10/1973 | Glenn |
| 3,851,376 | A | | 12/1974 | Gross et al. |

(Continued)

FOREIGN PATENT DOCUMENTS

| | | |
|---|---|---|
| DE | 20 07 378 | 11/1971 |
| EP | 0 042 011 | 12/1981 |

(Continued)

OTHER PUBLICATIONS

English translation of JP Office Action mailed Dec. 16, 2011 in corresponding Japanese application.

(Continued)

*Primary Examiner* — Edward Tolan
*Assistant Examiner* — Pradeep C Battula
(74) *Attorney, Agent, or Firm* — Nixon & Vanderhye P.C.

(57) ABSTRACT

An apparatus (50) for and method of manufacturing helically wound tubular structures (116) includes a rotating faceplate (74) upon which are mounted a plurality of diameter defining rollers (78) which, in operation, cause a strip material (80) to be plastically deformed into a helical winding which may be lain down in abutting or self-overlapping relationship to form said tubular structure (116).

31 Claims, 4 Drawing Sheets

(56) References Cited

U.S. PATENT DOCUMENTS

| | | | | | |
|---|---|---|---|---|---|
| 4,080,815 | A | * | 3/1978 | Foster | 72/168 |
| 4,081,981 | A | | 4/1978 | Lipp | |
| 4,337,564 | A | * | 7/1982 | Menzel et al. | 72/50 |
| 4,353,232 | A | | 10/1982 | Viesturs et al. | |
| 4,597,276 | A | * | 7/1986 | Legallais et al. | 72/49 |
| 4,622,838 | A | | 11/1986 | Schafer | |
| 4,724,596 | A | | 2/1988 | Pavlyak | |
| 4,738,008 | A | * | 4/1988 | Proctor | 72/49 |
| 4,783,980 | A | | 11/1988 | Varga | |
| 4,791,800 | A | | 12/1988 | Alexander | |
| 4,799,372 | A | | 1/1989 | Marcon et al. | |
| 4,895,011 | A | | 1/1990 | Varga | |
| 5,051,285 | A | | 9/1991 | Borzakian | |
| 5,375,404 | A | | 12/1994 | Conway | |
| 5,593,101 | A | | 1/1997 | Varga | |
| 5,837,083 | A | | 11/1998 | Booth | |
| 6,089,276 | A | | 7/2000 | Miyazaki et al. | |
| 6,209,607 | B1 | | 4/2001 | Foos | |
| 6,378,193 | B1 | * | 4/2002 | du Chaffaut et al. | 72/50 |
| 2008/0190508 | A1 | | 8/2008 | Booth et al. | |
| 2010/0003440 | A1 | | 1/2010 | Booth | |

FOREIGN PATENT DOCUMENTS

| | | |
|---|---|---|
| EP | 0 104 844 | 4/1984 |
| EP | 0 148 061 | 7/1985 |
| EP | 0 357 658 | 2/1994 |
| EP | 0 335 969 | 7/1994 |
| EP | 812648 | 12/1997 |
| FR | 2 203 379 | 5/1974 |
| GB | 110 576 | 10/1917 |
| GB | 266876 | 3/1927 |
| GB | 401 139 | 11/1933 |
| GB | 846621 | 8/1960 |
| GB | 927980 | 6/1963 |
| GB | 1 557 523 | 12/1979 |
| GB | 2 099 539 | 12/1982 |
| GB | 2 213 748 | 8/1989 |
| GB | 2 280 889 | 2/1995 |
| JP | 47-1528 | 1/1972 |
| JP | 51-26392 | 8/1976 |
| JP | 51-96762 | 8/1976 |
| JP | 53-142361 | 12/1978 |
| JP | 55-37371 | 3/1980 |
| JP | 59 061522 | 7/1984 |
| JP | 60-187427 | 9/1985 |
| JP | 63-256219 | 10/1988 |
| JP | 6-210457 | 8/1994 |
| JP | 7-265943 | 10/1995 |
| JP | 9-122744 | 5/1997 |
| WO | WO 88/08620 | 11/1988 |
| WO | WO 89/03730 | 5/1989 |
| WO | WO 02/052184 | 7/2002 |

OTHER PUBLICATIONS

Chinese First Office Action dated Feb. 12, 2010 and English translation thereof for CN Appln. 200680048996.7.

International Search Report for PCT/GB2006/050471, mailed May 23, 2007.

Written Opinion for PCT/GB2006/050471, mailed May 23, 2007.

International Preliminary Report on Patentability for PCT/GB2006/050471, mailed Nov. 12, 2007.

Office Action issued for Canadian Patent Application No. 2,632,644, dated Nov. 4, 2013.

* cited by examiner

APPARATUS FOR AND METHOD OF MANUFACTURING HELICALLY WOUND STRUCTURES

This application is a Division of application Ser. No. 12/086,982, filed Jun. 23, 2008, which is the US national phase of international application PCT/GB2006/050471, filed in English on Dec. 21, 2006, which designated the US. PCT/GB2006/050471 claims priority to GB Application No. 0526409.8 filed Dec. 23, 2005. The entire contents of these applications are incorporated herein by reference.

The present invention relates to an apparatus for and method of manufacturing helically wound structures and relates particularly to the manufacture of pipes and longitudinal structures formed by winding strips of metal in a helically overlapping relationship. Other structures such as storage vessels, towers and support structures may also benefit from features described herein.

Presently it is known to manufacture tubular structures by winding pre-formed metal strip onto a rotating mandrel such that the strip is deposited onto the mandrel in a self-overlapping manner and is retained in place by mechanical deformation of an edge thereof such that it interlocks with an adjacent edge, thereby to retain the strip in place on the final structure. EP0335969 discloses an apparatus for forming a helically wound tubular structure formed from a flat strip of metal wound onto a mandrel. The flat strip is fed from one or other of a pair of supply spools mounted concentrically with the axis of the tubular structure to be made. A rotating winding head is used to wind the strip onto the mandrel and includes a plurality of powered forming rollers which impart an initial form to the cross section of the metal strip before it is passed to a final set of rollers that lay the strip onto the mandrel and then swage over an edge of the strip so that it becomes mechanically locked to the previous layer over which it is wound. This is a complex process. Also provided is a mechanism for ensuring the strip supply is maintained constant and this mechanism includes speed control of the forming rollers. The coaxial supply bobbins are fed from an external supply spool so as to maintain the supply thereof. A welding station is used to join one end of the strip material to another without having to stop the machine.

It is also known to control the final diameter of the formed pipe by controlling a plurality of radius forming rollers immediately before the strip is wound into its final structure. Such an arrangement is disclosed in U.S. Pat. No. 3,851,376 which relates to a method and apparatus for forming a helical seam sealed metal pipe in which the spring back force of the material is controlled within permissible limits. A plurality of forming rollers are provided for this purpose and include a three roller arrangement of fixed rollers the position of which is selected and set to impart a desired radius of curvature to a metal strip as it passes through the rollers. An additional roller is displaceable in response to a feedback signal indicative of the spring back force so as to increase or decrease the forming force as necessary so as to ensure the spring back force is maintained within desired limits.

It is also known to elastically deform a metal strip and wind it into a self overlapping helically wound structure and employ an adhesive to maintain the strip in its final shape. Unfortunately, the strip retains its desire to return to its relaxed (flat) shape and the adhesive is necessary in order to prevent the strip delaminating and unwinding. Additionally, the final structure suffers from a high peel force created by the stresses within the plastically deformed strip and these put a great load on the adhesive itself, thereby compromising the structural integrity of the structure and limiting its pressure capacity significantly below its theoretical limit.

Whilst the above arrangements provide perfectly acceptable methods of manufacturing pipes they either rely on plastic deformation of an edge of the material strip to ensure the product stays together or must rotate the final product during the forming process, both of which can be problematic. For example, the force required to deform an edge of the metal strip as it is lain down onto a previously deposited layer and lock it thereto is significant. Additionally, such machines consume unnecessarily large amounts of energy and are very slow as operating such a deformation process at high speed is extremely difficult. The latter problem of having to rotate the product during forming limits the use of this arrangement to the production of relatively short sections of pipe and such sections must be joined if a long section is required. When laying trans-continental pipelines it is extremely undesirable to have to introduce any such joints as they tend to be expensive to incorporate and problematic in operation.

It is an object of the present invention to provide an apparatus for and method of manufacturing tubular structures which reduces and possibly overcomes some of the problems associated with the prior art.

Accordingly, the present invention provides an apparatus for manufacturing a tubular structure of helically wound strip comprising: a faceplate, mounted for rotation about a longitudinal axis; a drive mechanism, for driving the faceplate in a first direction about said longitudinal axis; and diameter defining rollers, mounted on said faceplate for causing the strip material to bend to a predetermined diameter prior to being formed into a tubular structure.

Preferably, the apparatus includes an assembly of shaping rollers, mounted for rotation with said faceplate and for forming a cross-sectional profile on strip material prior to it being formed to a pre-determined diameter. One or more of said shaping rollers may be driven rollers.

Preferably, the diameter defining rollers include three mutually confronting rollers, one of which is adjustable relative to the other two so as to cause any strip material passing between said rollers to adopt a radius of curvature defined by the positional relationship between said rollers.

In a particular arrangement the diameter defining rollers include a pair of pinch rollers rotatable about their own longitudinal axes and between which a strip of material may pass and a ring roller which is adjustable relative to a first pinch roller by rotation about the axis of the second.

In a most convenient arrangement the apparatus includes an actuator connected to said ring roller for effecting adjustment relative to said second pinch roller.

Advantageously, the apparatus may be provided with a reaction roller against which forming forces exerted on any strip as it is caused to adopt a radius of curvature by the ring roller will be reacted.

Preferably, the apparatus includes a second actuator for causing the axial position of the reaction roller to be varied relative to a pinch roller. An actuator may also be provided for effecting axial adjustment of one of said pinch rollers relative to the other.

Advantageously, the apparatus includes drive means for driving one or more of said diameter defining rollers.

In a particularly convenient arrangement the apparatus includes a computer coupled to said actuator or actuators for controlling the positional relationship of the roller or rollers. Said computer may comprise a computer programmed to control said roller or rollers in accordance with a predetermined programme.

Preferably, the apparatus includes a first gearing assembly mounted on said faceplate and driven from a fixed gear arranged coaxially with said faceplate and in which said first gearing assembly is engaged with said diameter defining rollers for driving said diameter defining rollers.

Conveniently, the apparatus further includes a second gearing assembly mounted on said faceplate and driven from a fixed gear arranged coaxially with said faceplate and in which said second gearing assembly is engaged with said forming rollers for driving said rollers. The apparatus may also include a main drive member for driving said faceplate in said first direction which may comprises a driven gear engaged with a corresponding gear portion on said faceplate.

Conveniently, the apparatus includes a stock support for supporting a supply of stock of strip material for being formed into a tubular structure. The stock support may comprise a circumferentially extending cassette extending around said faceplate on an outer diameter thereof.

Conveniently, said cassette comprises a plurality of support rollers circumferentially spaced around the longitudinal axis and which cooperate with a portion of a supply of strip stock and allow said stock to rotate about said axis. Said support rollers may be mounted for rotation about a spindle secured to a non rotating portion of said assembly.

In a particular arrangement the forming rollers are staggered along said longitudinal axis and in which the axis of rotation of said rollers relative to said axis varies in accordance the spiral angle of the trip as it passes from a supply thereof to said diameter defining rollers.

Conveniently, the apparatus may include a first strip supply guide roller for guiding a supply of strip material from a store thereof to said forming rollers. The apparatus may also include a second strip supply roller for guiding a supply of formed strip from said diameter defining rollers to an inner diameter at which a tubular member is to be formed.

Advantageously, the apparatus includes an adhesive applicator for applying an adhesive onto at least a portion of any strip after it passes through said diameter forming rollers. Said adhesive applicator may comprise an adhesive storing cassette for storing a roll of adhesive strip. Said adhesive storing cassette may include a spindle mounted on said faceplate for rotation therewith and around which a supply of adhesive strip may be positioned and rotate upon application of said adhesive strip to said tubular structure forming strip.

The apparatus may further include a backing removing mechanism for removing any protective backing on said adhesive strip prior to said adhesive strip being applied to the tubular structure forming strip.

Advantageously, the faceplate includes a central hole for receiving a core liner onto which said tubular forming strip may be wound to form a final tubular structure. Conveniently, there is provided a central support trunion having a hollow centre which defines said central hole for receiving said core liner.

Preferably, said support trunion is non rotating and includes a gear thereon which forms said fixed gear from which said rollers are driven.

Conveniently, said faceplate is mounted for rotation on said support trunion.

Advantageously, said faceplate includes a receiving station for receiving a supply of flat strip material to be formed into a tubular structure. Said receiving station may comprise a ring having a diameter corresponding to the diameter of the cassette, thereby to facilitate transfer of strip material therebetween upon depletion of material from said cassette.

Conveniently, the apparatus includes a supply means for supplying strip material to said receiving station as said station rotates, thereby to wind said strip material onto said receiving station in advance of material on said cassette being depleted.

According to a further aspect of the present invention there is provided a method of manufacturing a tubular structure comprising the steps of: bending a strip of material into a helical form by plastic deformation thereof; and winding said bent strip in a self overlapping manner into a tubular structure; wherein the strip is bent into said helical form with a radius of curvature less than the final radius of the structure to be formed.

Preferably, the method includes the step of passing said strip through a pair of pinch rollers and a ring roller adjustable relative to one of said pinch rollers such as to cause said strip to adopt said desired radius of curvature.

Advantageously, the method includes the step of passing the strip through a pair of pinched rollers, the axis of rotation of which are displaced relative to each other such as to cause said strip to adopt a bend along its length thereby to impart a sideways bend into said strip and create a strip having one edge longer than the other.

The method may include the step of applying an adhesive to portions of said strip which will be overlapping when formed into a tubular structure. Said adhesive may be applied by applying the adhesive as a strip of adhesive.

Advantageously, the method includes the step of protecting said strip of adhesive by applying a protective coating to at least one surface thereof and removing said protective coating prior to applying said adhesive onto said strip which forms said tubular structure.

Conveniently, the method includes the step of providing a tubular core and winding said strip onto said core so as to produce a tubular structure having an inner core and an outer casing of helically wound material. Preferably, the step of forming said tubular core is by roll forming a strip of material along its length and seam welding abutting longitudinal edges.

Alternatively, the method may include the step of forming said tubular core as a series of discrete lengths of tube and assembling them into a continuous or near continuous length prior to winding said strip material onto said core. Alternatively said tubular core may be provided as a length of extruded pipe of a plastics material.

In one arrangement said discrete lengths of tube are of a ceramics material.

The present invention will now be more particularly described by way of example only with reference to the accompanying drawings in which.

Figure 1:
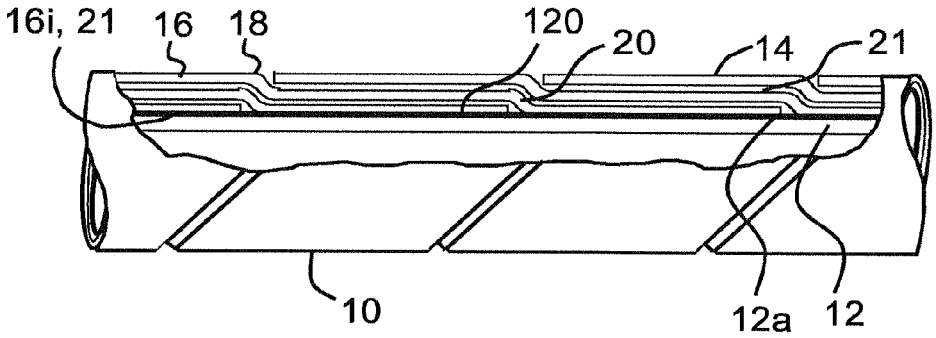
FIGS. 1 and 2 are partial cross-sectional views of two types of tubular structure that may be formed by the apparatus described herein.

Referring now to FIG. 1 of the drawings, a tubular body indicated generally at 10 forms a pipe for use in a pipe system such as a pipeline carrying hot fluids (which may also be under pressure). The tubular body comprises an inner portion in the form of an inner hollow core 12 which may be formed by any one of a number of forming processes, as discussed above and an outer load carrying casing discussed in detail later herein. In the preferred process the inner pipe comprises a continuously formed core, as will also be discussed in detail later herein however, one may have a core made from a plurality of discrete lengths inter-engaged with each other so as to form a long length. The outer casing indicated generally at 14 is formed on the inner hollow core 12 by helically winding a strip 16 of material onto the outer surface 12*a* of the core 12 in self-overlapping fashion similar to the manner which is described in detail for the formation of a pipe on a mandrel in the specific descriptions of the applicants U.K. Patent No. 2,280,889 and U.S. Pat. No. 5,837,083. In accordance with one aspect of the present invention the strip may be wound under tension. The strips 16 which form the outer casing may have one or more transverse cross-sectional steps 18 and 20 each of which is preferably of a depth corresponding to the thickness of the strip 16. The steps 18, 20 are preferably preformed within the strip 16, each extending from one end of the strip 16 to the other to facilitate an over-lapping centreless winding operation in which each convolution of the strip accommodates the overlapping portion of the next convolution. Whilst the strip may comprise any one of a number of materials such as a plastic, a composite material or indeed metal, it has been found that metal is particularly suitable in view of its generally high strength capability and ease of forming and joining as will be described later herein. Examples of suitable metals include steel, stainless steel, titanium and aluminium, some of which are particularly suitable due to their anti-corrosion capabilities. The internal surface 16*i* of the strip 16 and the outer surface of the pipe 12*o* may be secured together by a structural adhesive, as may the overlapping portions 16*a* of the strip. The use of an adhesive helps ensure that all individual components of the tubular member 10 strain at a similar rate. The application of the adhesive may be by any one of a number of means but one particularly suitable arrangement is discussed in detail later herein together with a number of other options.

Figure 3:
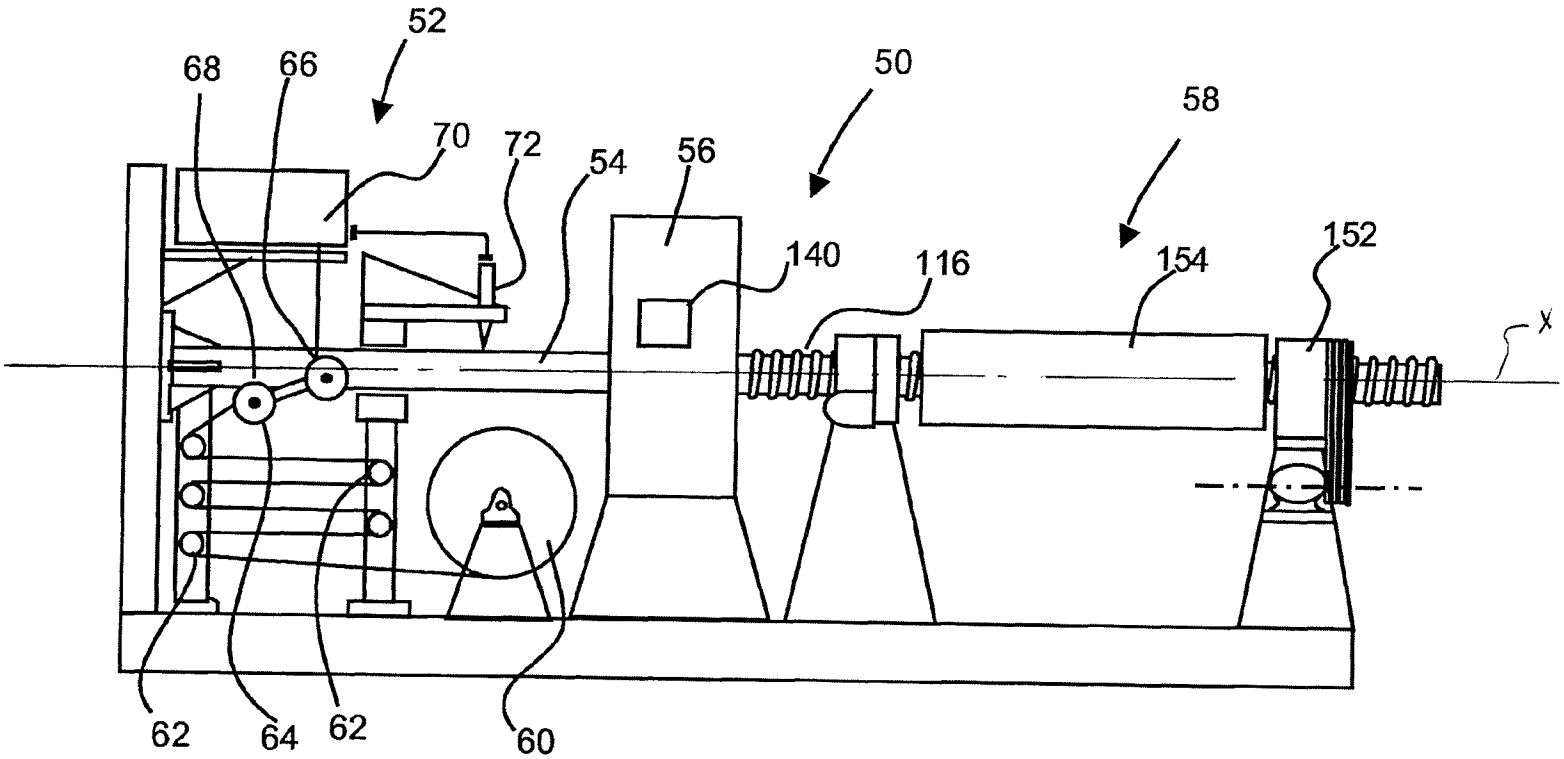
FIG. 3 is a schematic side elevation of an apparatus according to aspects of the present invention.

Referring now more particularly to FIG. 3, from which it will be seen that an apparatus 50 for manufacturing helically wound structures comprises: an optional pre-forming portion 52, in which a core 54 is formed; a forming station, shown schematically at 56 and described in detail later herein; and a post forming section, shown generally at 58 and including a number of optional features discussed later. In one arrangement of the optional pre-forming portion 52 there is provided a store of flat strip material in the form of a roll of metal strip 60 and a plurality of feed rollers 62 which feed the strip to forming rollers 64 and 66 which in turn roll the edges of the strip together around a central mandrel 68 so as to form a tubular structure 54 having confronting edges abutting each other (not shown). A welding apparatus shown generally at 70 and including a welding head 72 is used to weld together the confronting edges in a manner well known in the art and therefore not described further herein. An alternative core forming process might comprise the manufacture of a plurality of discrete lengths of tubular structure, each of which are provided with inter-engaging features on confronting ends thereof such as to allow a plurality of said lengths to be assembled into a long section of core. When employing such a core arrangement one may replace the strip forming and welding arrangement with a suitable feed mechanism (not shown) for feeding a plurality of said discrete lengths into the forming station in a continuous manner. Once formed, the core of whatever description is fed into the forming station 56, which is best seen with reference to FIGS. 4 and 5.

Figure 2:
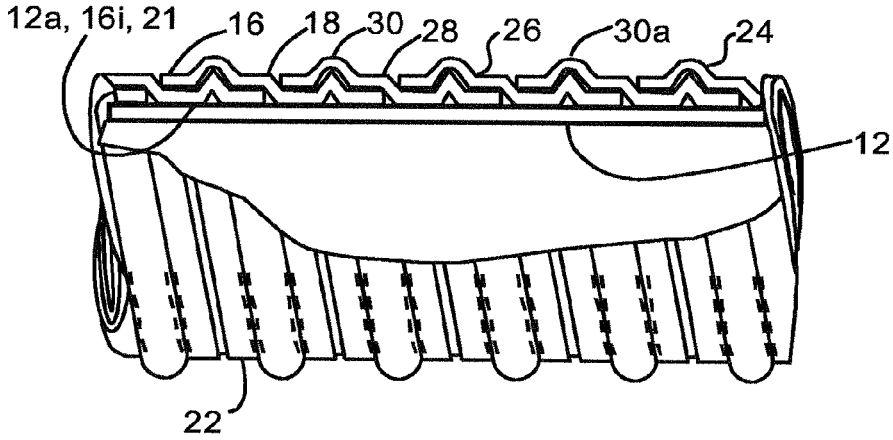
Figure 4:
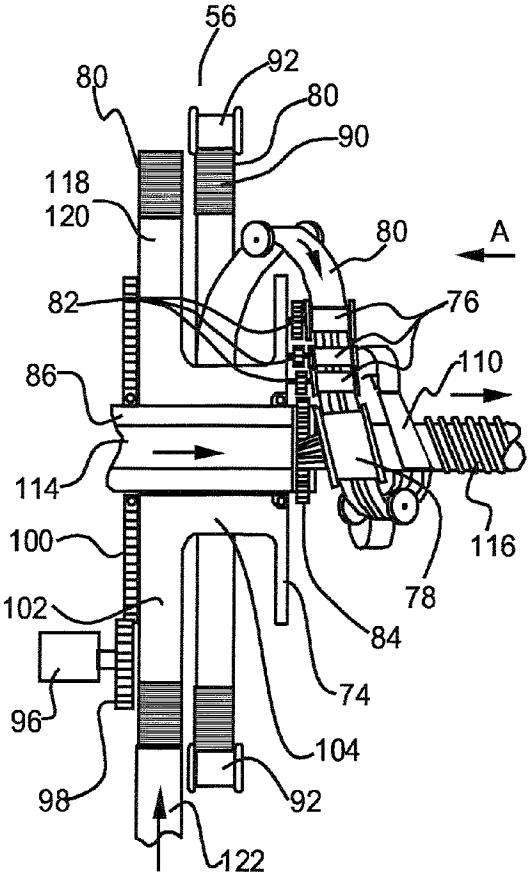
FIG. 4 is a side elevation of the forming head shown schematically in FIG. 3

Referring to the drawings in general but particularly FIG. 4 which is a side elevation of the forming station 56 and comprises a faceplate 74 upon which are mounted a plurality of shaping rollers 76 and a set of diameter defining rollers, shown generally at 78. As shown, the shaping rollers are profiled so as to form a cross-sectional form to the strip as best seen in FIG. 1 or 2. It will, however, be appreciated that the forming rollers could impart an alternative form to the strip or may, in some circumstances, be eliminated all together. When provided, the shaping rollers are best provided as a plurality of confronting rollers (best seen in FIG. 5) between which the strip 80 is sandwiched as it passes therebetween so as to impart the desired profile into the strip in a progressive manner, with each pair of rollers increasing the deformation of the strip until the final desired profile is formed. As shown, the shaping rollers are each driven by means of a drive gear 82 each of which is mounted for rotation about an axis on said faceplate and engages on one side with a shaping roller and on another side with a sun gear 84 formed on a non rotating portion 86, which is described in detail later herein. As the faceplate 74 rotates in the direction of arrow C (FIG. 5) gears 76 and 82 rotate therewith but as they are coupled to the sun gear 84 they are caused to rotate about their axes and drive the strip through the pinch formed between confronting shaping rollers 76. As shown, the shaping rollers are each slightly staggered along longitudinal axis X and the axis of rotation of each roller varies in accordance with the spiral angle as the strip 80 passes from the supply thereof to the diameter defining rollers 78. It will, however, be appreciated that a simpler non staggered arrangement may be used where there is sufficient room to shape the strip and then position it correctly before applying it to the radius forming rollers 78. In order to ensure an even feed of strip material form a supply thereof it may be desirable to provide a supply thereof in the form of stock supply 88. Advantageously this stock supply may be provided in a cassette or stock support 90 comprising a plurality of support rollers 92 positioned outside of said forming station and being circumferentially spaced around longitudinal axis X. Said support rollers 92 cooperate with a portion of the stock of strip material 88 and allows the stock to rotate about axis X. The strip material 80 is removed from an inner diameter of said stock thereof and fed via a first strip supply guide roller 94 mounted for rotation on said faceplate 74 about an axis substantially perpendicular thereto. In order to drive the faceplate 74 one may provide a motor 96 and gear drive 98 coupled to a ring gear 100 provided on a back plate 102 which is directly linked to face plate via annular portion 104 through which non rotating portion 86 extends.

Figure 5:
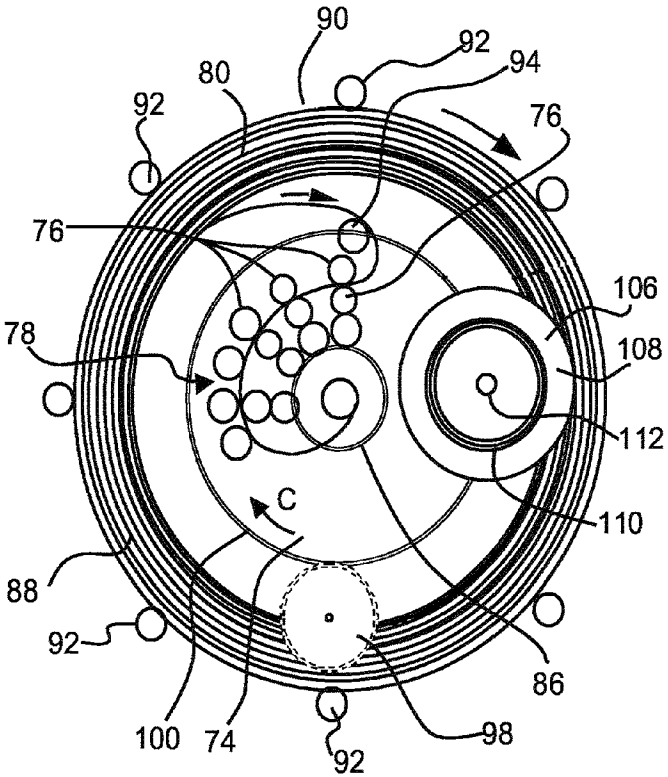
FIG. 5 is a front view of the forming head taken in the direction of arrow A in FIG. 4.

Also shown in FIGS. 4 and 5 is the diameter defining roller arrangement seen generally at 78 and which between them act to curve the strip material by plastically deforming it around one of the rollers such as to define the diameter of the exiting strip. This arrangement is best seen with reference to FIGS. 6 and 7 and is described in detail later herein. An optional adhesive applicator 106 may also be mounted on the faceplate 74 for rotation therewith. The applicator may take a number of forms for supplying adhesive to the strip after it has been formed and one particular arrangement is shown in which a storage cassette 108 is provided with a roll of adhesive strip 110. The storage cassette 108 is mounted for rotation about a spindle 112 mounted on the faceplate for rotation therewith such that upon rotation of the faceplate adhesive strip may be dispensed onto the surface of the strip 80 as it is lain down onto the core 54 (FIG. 3). The strip of adhesive may be provided in the form of a strip having a backing and this backing may be removed by backing removing means (not shown) prior to said adhesive being applied. It will be appreciated from the cross-sectional view of FIG. 4 that the faceplate 74 includes a central hole 114 for receiving a core or liner 54 onto which said strip material 80 may be wound so as to form a final structure 116. The central hole may be provided with a central support trunion 86 having a hollow centre which defines said central aperture 114 for receiving said core or liner 54. When provided, the trunion may be mounted within said central hole 114 by means of bearings 116, such that said faceplate 74 can rotate about said trunion 86. Also shown in FIG. 4 is a receiving station 118 in the form of ring 120 having a diameter corresponding to the diameter of the cassette thereby to facilitate the transfer of strip material therebetween upon depletion of the material on the cassette. A supply of strip material 122 forms a supply means for supplying strip material to said receiving station as said station rotates, thereby to wind said strip onto said supply station at the same rate as it is depleted form said cassette.

Figure 6:
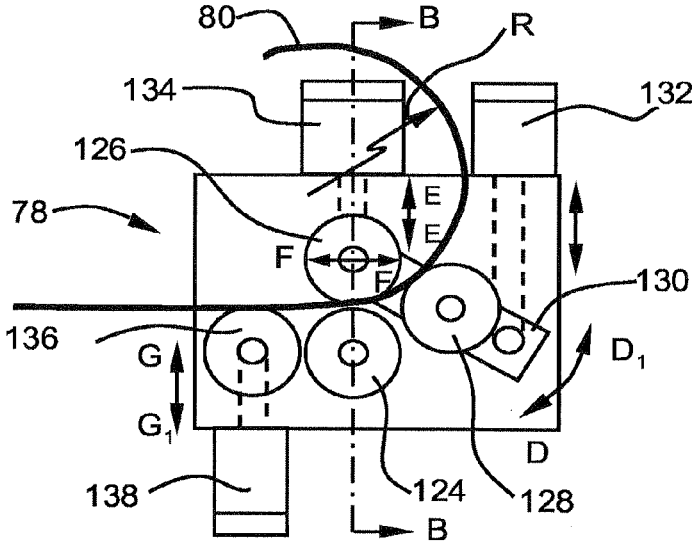
FIG. 6 is a detailed view of the diameter forming roller arrangement shown generally in FIGS. 4 and 5.
Figure 7:
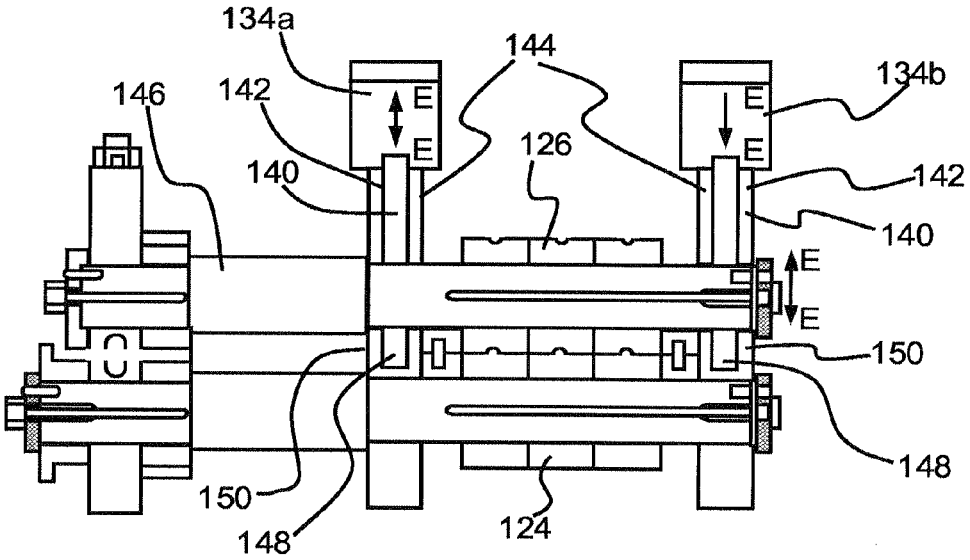
FIG. 7 is a cross-sectional view of the pinch rollers taken in the direction of arrows B-B in FIG. 6.

Turning now to FIGS. 6 and 7 which illustrate in more detail the format of the diameter forming rollers 78, it will be seen that the rollers include a pair of pinch rollers 124, 126 and a ring roller 128 mounted on a pivot arm 130 pivotable about the axis of rotation of one of the pinch rollers. It matters not which roller axis the pivot arm rotates. An actuator shown schematically at 132 is connected to the pivot arm 130 so as to initiate and control pivoting rotation of said ring roller in the direction of arrows D-D in accordance with desired control parameters discussed later herein. A further actuator 134 is provided to alter the position of one of the pinch rollers 126 relative to the other 124 in the directions of arrows E-E and F-F, again as discussed in detail later herein. A final reaction roller 136 is provided in order to react any forces experienced by the bending of the strip as it passes between the pinch rollers and the ring roller 124, 126 and 128 respectively. This reaction roller may also be controllable by actuator 138 so as to move it into or away from the strip 80 in the direction of arrows G-G as required. FIG. 7 illustrates by way of a cross-sectional drawing the actuator and roller control system in more detail. From this drawing it will be appreciated that actuator 134 is preferably provided as a matched pair, one at each end of roller 126 so as to allow differential and equal alteration of the axial position of roller 126. In this particular arrangement the actuator spindle 140 passes from the grounded actuator and through a hole 142 passing through an upper block portion 144, past roller spindle 146 (displaced relative thereto) and into lower block portion 146 into which it is anchored at 148. A small gap 150 provided between the blocks such that displacement of spindle 140 will cause roller 126 to move closer to or away from roller 124 in accordance with the actuator control parameters.

Referring now more particularly to drawings 6 and 7 collectively we will describe the control principles. As mentioned above, roller 126 is adjustable in the directions of arrows E-E and F-F by means of independently or collectively controlled actuators 134*a*, 134*b*. Roller 128 is movable in the direction of arrows D-$D_1$ by actuator 132 and roller 136 is movable in the direction of arrows G-$G_1$ by actuator 138. Each actuator is connected to and controlled by means of computer 140 (FIG. 3). In order to create the desired radius of curvature R on the strip 80 before it is lain down to form a tubular structure one simply needs to set and possibly adjust the position of roller 128 such that it causes the strip 80 to be bent about the axis of roller 126 and plastically deformed such that the desired degree of final bending is achieved after any spring-back effect. To set and adjust the degree of pinch that the strip experiences as it passes through pinch rollers 124, 126 one simply adjusts the axial position of roller 126 relative to roller 124. This adjustment can be a collective adjustment or a differential adjustment. Differential adjustment will cause one side of the strip to be pinched more than the other and if plastic deformation is induced this will cause one side of the strip to adopt a length slightly longer than the other. This arrangement helps the strip sit comfortably as it is lain down on the previously deposited layer of a multi-layer product. It will be appreciated that the longer edge is the edge that is first deposited down as this will be the edge that lies at the greater diameter and must fit to the diameter of the layer underneath it. As an alternative to differential movement in the direction of arrows E-E one might move roller 126 differentially in the direction of arrows F-F which will have a similar affect on the differential thickness. Should it be necessary to increase or alter the degree of bending the strip is subjected to then it may be necessary to adjust the axial position of roller 136 by actuating actuator 138 and move roller 136 appropriately.

Referring now once again to FIG. 3, an optional post forming section 58 may include such things as an optional drive mechanism 152 and adhesive curing heater 154.

Referring to the drawings in general, it will be appreciated that a tubular structure may be manufactured by causing the faceplate 74 to rotate. This action in turn will cause the strip material 80 to be drawn from the cassette, passed through shaping rollers 76 and into diameter defining rollers 78 at which point the desired diameter is formed by appropriate positional control of rollers 124, 126 and 128. As the strip exits the diameter defining rollers it is directed towards the core 54 and wrapped therearound in a self overlapping arrangement best appreciated with reference to FIGS. 1 and 2. Before the strip is finally deposited onto the core it may be supplemented by an adhesive dispensed as a strip thereof form dispenser 106. Continuous rotation of faceplate 74 will cause continuous deformation and deposition of the strip 80 and this process will continue so long as there is a supply of strip material within the cassette store. Once the strip material has been depleted it is necessary to transfer the secondary supply from station 118 across to the cassette and weld one end to the other before recommencing operations. It will also be appreciated that some forms of structure need not have a core and the above process may be undertaken without a core being supplied to the faceplate. In such an arrangement it may be necessary to provide a support to the initial portion of tubular structure formed but once an initial portion has been formed the structure will be self supporting as new layers are effectively deposited down on a stable multi layer structure. Indeed, one may well adopt such an arrangement when it is desirable to form a tapered structure for which one would find it difficult to produce a tapered inner core. Structures without cores are, therefore, within the scope of the present invention. In the production of such a tapered structure it is simply necessary to vary the degree of bending applied to the strip and this can be done by applying a variable force position to ring roller 128 so as to change the rolling radius as required. This process may be controlled by the computer 140 in accordance with a pre-determined control methodology.

Additional features of this machine include feedback control from the computer to ensure the product diameter is maintained within desired limits and/or altered according to desired parameters. It will be appreciated that as one can control the degree of plastic deformation of the strip as it passes through the radius forming rollers one can also control the final diameter of any tubular structure formed by this apparatus. One important feature of this machine is its ability to form the radius of curvature R such that it is slightly less than that of the core onto which it is to be wound. Such an arrangement has a significant affect on the final product as a strip so formed (to a smaller than required radius) as the outer helically wound strip will effectively grip the previous layer or the core and ensure close contact therebetween and thus provide a better mechanical joint therebetween than might be possible without this feature. Additionally, by plastically deforming the strip rather than elastically deforming the strip as is known in the art one will be placing any adhesive used under far less or possibly no peel loading at all, thus helping to maintain the integrity of the final structure and increasing its pressure capacity closer to its theoretical maximum.

It will also be appreciated that the above described method and apparatus may be used to cover an already existing pipeline with an outer casing. In this arrangement the already existing pipeline forms a core and the machine simply rotates around the core and moves therealong so as to lay down the outer wrap of strip material onto the pipeline. Such an approach could be employed when one wishes to repair or strengthen an already existing pipeline.

The invention claimed is:

1. An apparatus for manufacturing a tubular structure, said tubular structure comprising a permanent core and a helically wound strip wound over said permanent core, said apparatus comprising:

a feed mechanism for feeding said core into said apparatus;

a faceplate, mounted for rotation in a first direction about a longitudinal axis;

a drive mechanism, for driving the faceplate in said first direction about said longitudinal axis;

an assembly of shaping rollers, mounted for rotation with said faceplate and for forming a cross-sectional profile on said strip prior to it being formed to a pre-determined diameter; and at least one diameter defining roller mounted on said faceplate and configured to plastically deform said strip around one of said at least one diameter defining roller to have a radius of curvature less than a radius of curvature of said core prior to being formed into a tubular structure.

2. An apparatus as claimed in claim 1 in which one or more of said shaping rollers are driven rollers.

3. An apparatus as claimed in claim 1 in which the at least one diameter defining roller comprises three mutually confronting rollers, one of which is adjustable relative to the other two so as to cause said strip passing between said rollers to adopt a radius of curvature defined by the positional relationship between said rollers.

4. An apparatus as claimed in claim 1 including first and second pinch rollers rotatable about roller longitudinal axes and between which said strip may pass and a ring roller which is adjustable relative to said first pinch roller by rotation about the axis of the second pinch roller.

5. An apparatus as claimed in claim 4 and including an actuator connected to said ring roller for effecting adjustment relative to said second pinch roller.

6. An apparatus as claimed in claim 4 and including an actuator connected to said ring roller for effecting adjustment relative to said second pinch roller and further including a second actuator for causing the axial position of the reaction roller to be varied relative to a pinch roller.

7. An apparatus as claimed in claim 4 including an actuator for effecting axial adjustment of one of said pinch rollers relative to the other.

8. An apparatus as claimed in claim 4 including an actuator connected to said ring roller for effecting adjustment relative to said second pinch roller and including a computer coupled to said actuator or actuators for controlling the positional relationship of the ring roller.

9. An apparatus as claimed in claim 4 including an actuator connected to said ring roller for effecting adjustment relative to said second pinch roller and including an actuator connected to said ring roller for effecting adjustment relative to said second pinch roller and further including a computer coupled to said actuator or actuators for controlling the positional relationship of the roller or rollers further in which said computer comprises a computer programmed to control said roller or rollers in accordance with a predetermined program.

10. An apparatus as claimed in claim 1 including a reaction roller against which forming forces are exerted on said strip.

11. An apparatus as claimed in claim 1 and including a first gearing assembly mounted on said faceplate and driven from a fixed gear arranged coaxially with said faceplate and in which said first gearing assembly is engaged with said at least one diameter defining roller for driving said at least one diameter defining roller.

12. An apparatus as claimed in claim 11 and further including an assembly of shaping rollers, mounted for rotation with said faceplate and for forming a cross-sectional profile on said strip prior to it being formed to a pre-determined diameter and a second gearing assembly mounted on said faceplate and driven from a fixed gear arranged coaxially with said faceplate and in which said second gearing assembly is engaged with said shaping rollers for driving said rollers.

13. An apparatus as claimed in claim 1 and including a main drive member for driving said faceplate in said first direction.

14. An apparatus as claimed in claim 13 in which said main drive member comprises a driven gear engaged with a corresponding gear portion on said faceplate.

15. An apparatus as claimed in claim 1 and further including a strip support for supporting a supply of strip material for being formed into a tubular structure.

16. An apparatus as claimed in claim 15 in which said strip support comprises a circumferentially extending cassette extending around said faceplate on an outer diameter thereof.

17. An apparatus as claimed in claim 15 in which said strip support comprises a circumferentially extending cassette extending around said faceplate on an outer diameter thereof and in which said cassette comprises a plurality of support rollers circumferentially spaced around the longitudinal axis and which cooperate with a portion of a supply of strip and allow said strip to rotate about said axis.

18. An apparatus as claimed in claim 15 in which said strip support comprises a circumferentially extending cassette extending around said faceplate on an outer diameter thereof, in which said cassette comprises a plurality of support rollers circumferentially spaced around the longitudinal axis and which cooperate with a portion of a supply of strip and allow said strip to rotate about said axis and in which said support rollers are mounted for rotation about a spindle secured to a non rotating portion.

19. An apparatus as claimed in claim 1 in which the shaping rollers are staggered along said longitudinal axis and in which the axis of rotation of said rollers relative to said axis varies in accordance with the spiral angle of the strip as it passes from a supply thereof to said diameter defining rollers.

20. An apparatus as claimed in claim 1 including a first strip supply guide roller for guiding a supply of strip material from a store thereof to said shaping rollers.

21. An apparatus as claimed in claim 1 including an adhesive applicator for applying an adhesive onto at least a portion of any strip after it passes through said diameter forming rollers.

22. An apparatus as claimed in claim 21 in which said adhesive applicator comprises an adhesive storing cassette for storing a roll of adhesive strip.

23. An apparatus as claimed in claim 21 in which said adhesive applicator comprises an adhesive storing cassette for storing a roll of adhesive strip and in which said adhesive storing cassette includes a spindle mounted on said faceplate for rotation therewith and around which a supply of adhesive strip may be positioned and rotate upon application of said adhesive strip to said tubular structure forming strip.

24. An apparatus as claimed in claim 21 in which said adhesive applicator comprises an adhesive storing cassette for storing a roll of adhesive strip and the apparatus further comprises a backing removing mechanism for removing any protective backing on said adhesive strip prior to said adhesive strip being applied to the tubular structure forming strip.

25. An apparatus as claimed in claim 1 in which the faceplate includes a central hole for receiving a core onto which said strip may be wound to form a final tubular structure.

26. An apparatus as claimed in claim 25 including a central support trunion having a hollow centre which defines said central hole for receiving said core.

27. An apparatus as claimed in claim 25 including an assembly of shaping rollers, mounted for rotation with said faceplate and for forming a cross-sectional profile on said strip prior to it being formed to a pre-determined diameter a central support trunion having a hollow centre which defines said central hole for receiving said core and in which said support trunion is non rotating and includes a gear thereon which forms a fixed gear from which said shaping rollers are driven.

28. An apparatus as claimed in claim 25 in which said apparatus includes a support trunion and said faceplate is mounted for rotation on the support trunion.

29. An apparatus as claimed in claim 1 in which said faceplate includes a receiving station for receiving a supply of flat strip material to be formed into a tubular structure.

30. An apparatus as claimed in claim 29 and including a cassette of strip material having a diameter and in which said receiving station comprises a ring having a diameter corresponding to the diameter of the cassette, thereby to facilitate transfer of strip material therebetween.

31. An apparatus as claimed in claim 30 and including supply means for supplying strip material to said receiving station as said station rotates, thereby to wind said strip material onto said receiving station in advance of material on said cassette being depleted.

* * * * *